United States Patent [19]

Chow et al.

[11] Patent Number: 4,922,687

[45] Date of Patent: May 8, 1990

[54] AUTOMATED PACKAGING LOOSE FILL SYSTEM

[75] Inventors: Carl S. Chow, Mountain View, Calif.; Timothy J. Zantow, Baraboo, Wis.; Mok-Wing Fung, Stanford; Hansgregory C. Hartmann, Sunnyvale, both of Calif.

[73] Assignee: Hewlett-Packard Company, Palo Alto, Calif.

[21] Appl. No.: 342,917

[22] Filed: Apr. 24, 1989

[51] Int. Cl.[5] ..... B65B 55/20

[52] U.S. Cl. ..... 53/472; 53/238; 53/474; 53/504

[58] Field of Search ..... 53/472, 474, 504, 55, 53/69, 445, 155, 154, 239, 238, 237

[56] References Cited

U.S. PATENT DOCUMENTS

| | | | |
|---|---|---|---|
| 4,250,683 | 2/1981 | Barnett | 53/374 X |
| 4,702,060 | 10/1987 | Reid | 53/504 X |
| 4,713,927 | 12/1987 | Rubens et al. | 53/472 |
| 4,800,708 | 1/1989 | Sperry | 53/474 X |

*Primary Examiner*—James F. Coan
*Attorney, Agent, or Firm*—Alan H. Haggard

[57] ABSTRACT

A device and method for filling open boxes, containing such products as electronic equipment, with loose fill. The boxes are fed one at a time to a conveyor in random order. A bar code applied to each box, giving the box size, is scanned. The boxes are longitudinally centered by electric eyes actuating a brake at a centering station along the conveyor. The boxes are then widthwise centered by a pair of successively actuated cylinders. A pump-up cylinder at the centering station is actuated to lift a centered box to a predetermined height set by said bar code. A fill valve for loose fill has a supply of loose fill at its upper end fed to it through a feed pipe by gravity, the loose fill flowing by gravity, once the valve is opened, until its feed pipe is plugged, and then it is shut off. The pump-up cylinder then lowers the box to the conveyor. A series of air-blasts, sent to the box further along the conveyor, levels any mountain of loose fill that forms during the feeding of the loose-fill.

11 Claims, 4 Drawing Sheets

AUTOMATED PACKAGING LOOSE FILL SYSTEM

This invention relates to an automated packaging loose fill system.

BACKGROUND OF THE INVENTION

The efficient packaging of computer accessories such as software, modems, and cables is an industry-wide problem. Most of these items are individually prepackaged and wrapped in cellophane.

Every computer accessory order is a custom order and is shipped in individual boxes. In one such plant, there are seven different box sizes ranging from 9.5"×9.5"×6" to 24"×18"×17". Workers read the order sheet, select the requested items, and chose an appropriate box size. Loose fill is then added to each box to prevent movement of the product and possible resultant damage to it during shipping.

Heretofore, the loose fill operation has been done manually. The operator had to perform a variety of tasks. First, he took a box in which the order had been filled and centered it at a loose-fill filling station. Second, he operated a foot pedal to open a valve which let loose fill flow into the box. Usually the box overflowed with loose fill, and the excessive loose fill was recovered. Third, he judged when the amount of loose fill was correct. Fourth, he leveled the amount of loose fill by hand. Fifth, he folded the box flaps and hand fed the box to a taping machine.

There have been several problems with such a loose-fill operation. First, it was the bottleneck operation of the shipping department. The operator could not keep up with the number of boxes flowing into this station. As the volume of boxes shipped per day increased, the problem got worse. Second, the job itself has involved stooping over a counter. Third, the job was highly repetitive.

SUMMARY OF THE INVENTION

According to the present invention, a box-feeding machine feeds to the system one box at a time in random order. A bar-code reader scans a bar code on the bottom or side of the box. A control system uses the information read from the bar code to obtain the box size and thereby to determine the distance to be traveled by centering and pump-up cylinders.

The box then travels to the fill station, where longitudinal centering is achieved by a photoelectric sensor that activates a conveyor brake. The box is then centered widthwise by a pair of centering cylinders that act successively. Next, the box is lifted on a platform by the pump-up cylinder to a pre-determined height beneath a loose-fill valve in order to yield the correct amount of loose fill. Each box is lifted to a selected height. With the box flaps in their "up" position, the valve is then opened, and loose fill flows through a pipe until the pipe is clogged. The valve is then shut off, and the box is lowered.

At this point, the box contains the correct amount of loose fill. However, a "mountain" of fill has been formed by the unique filling process. Hence, the machine levels the loose fill "mountain" by means of a succession of short blasts of air. The box is then sent on to a closing station, ready to be closed and sealed.

No sensors are used for the purpose of detecting either the filled or the unfilled volume in each box. With this filling method, the actual amount of products in the box is unimportant. The correct amount of loose fill is always added, given that the box is bar coded to record its size and is thereby lifted to the correct level by the pump-up cylinder.

The complete process is computer controlled. As stated, the process first reads a bar code printed on the box to identify the box size and to set the system to accommodate that size. Second, the box is automatically stopped at the loose-fill filling station by a photoelectric sensor, which activates a conveyor brake. Next, the box is centered by the successively acting, opposing, centering cylinders. The box is then raised and is filled with loose fill by the process. Lastly, the box is lowered, and the "mountain" of loose fill is leveled by a series of blasts of air. The box is then ready to be sent on to a location where it will be closed and sealed.

The system has been found to be capable of filling a box with the correct amount of loose fill within a 30-second cycle time. In addition:

1. The boxes are centered width-wise to $+\frac{1}{8}''$.
2. Only two sensors are necessary to center any box length.
3. The air jets are effective loose-fill levelers.

DESCRIPTION OF A PREFERRED EMBODIMENT

Figure 1:
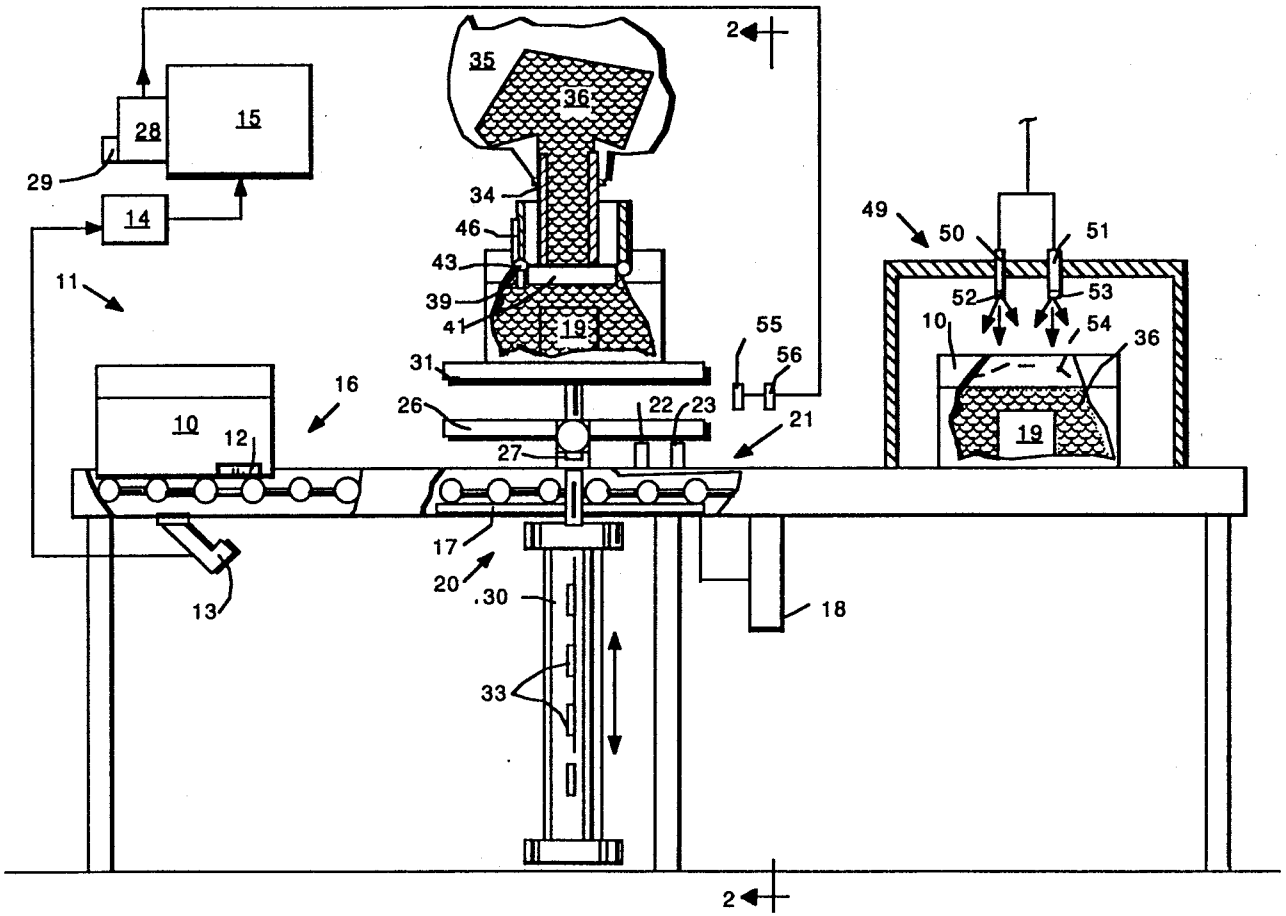
FIG. 1 is a view in front elevation of the loose-filling apparatus shown in open-valve position. Some portions are broken away and shown in section.

In order to get information concerning the size of a box 10 entering the fill machine 11, a pre-printed bar code 12 is utilized. The bar code has been printed, preferably, on the bottom or, as shown, on the side of the box 10, and it is read as it enters the fill machine 11. A bar code laser 13 may read the bar code 12, and send the information to a standard bar-code decoder 14, which relays the information to a computer 15. The computer 15 uses the information to control the centering, pump up, and filling processes, all according to the size of the box 10.

Figure 2:
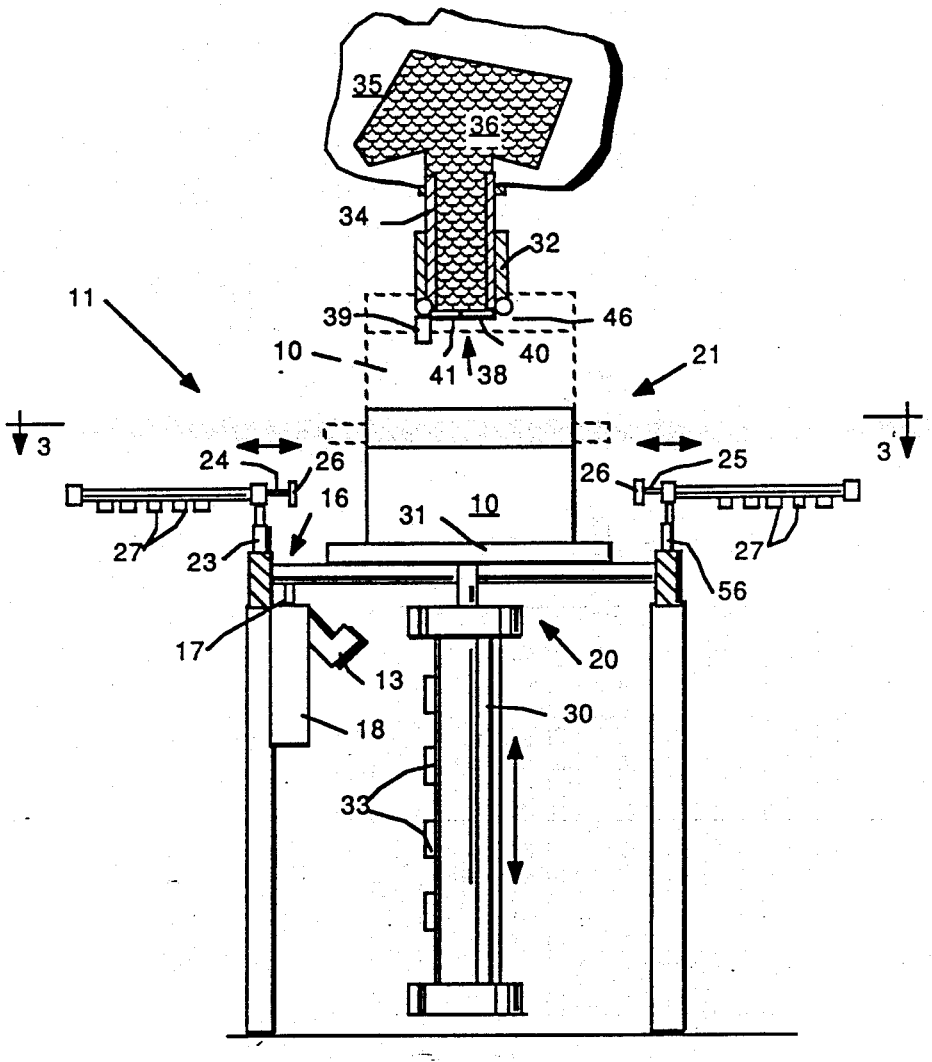
FIG. 2 is a view in section along the line 2—2 in FIG. 1 with the loose-fill gates closed. Solid lines show the box in a lower position, and broken lines show it in an upper or filling position.
Figure 3:
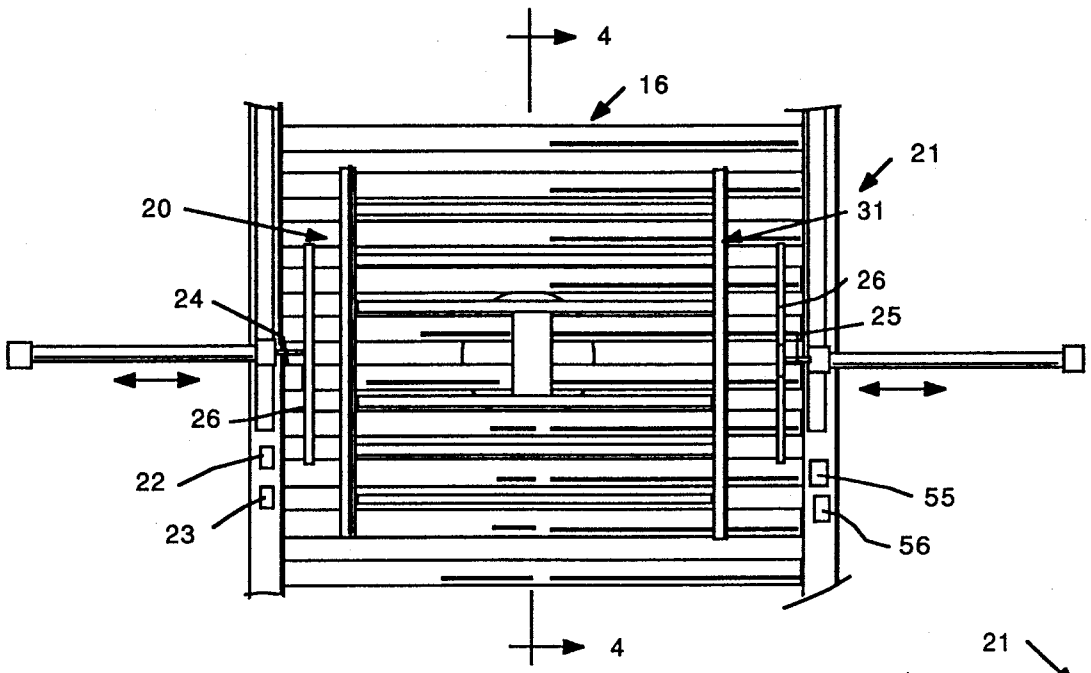
FIG. 3 is a view in section taken along the line 3—3 in FIG. 2.
Figure 4:
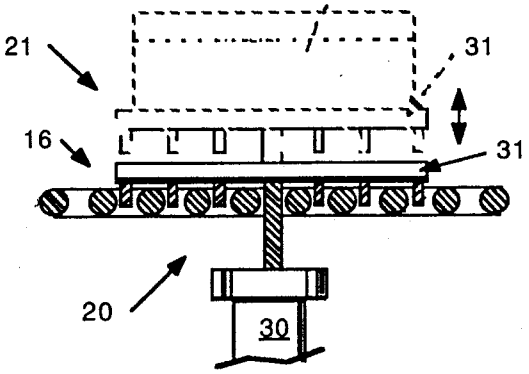
FIG. 4 is a view in section taken along the line 4—4 in FIG. 3.
Figure 5:
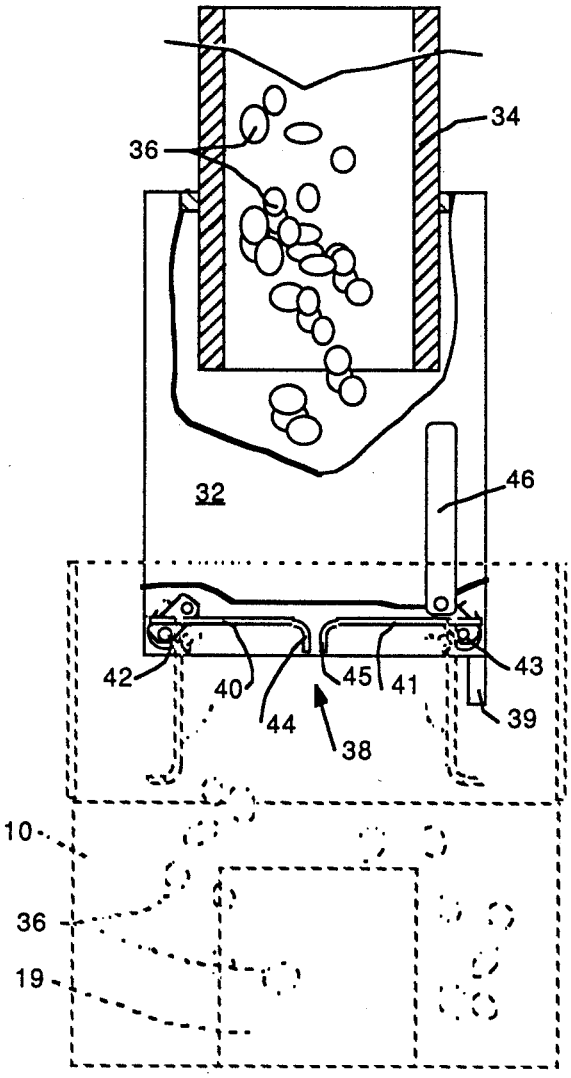
FIG. 5 is an enlarged view in elevation and partly in section of the loose-filling valve shown closed in solid lines and shown open in dotted lines.

A power-driven roller entrance or lead-in conveyor 16 for the box 10 may, typically, be about 5 feet long and 30 inches wide and conveys the box 10 to a second conveyor 20. The conveyor 20 spans a loose fill station 21 and has a brake 17 that when energized acts to stop the conveyor 20. The brake 17 is activated by a compressed air supply 18 (FIG. 2). Only one brake 17 is required for the conveyor 20, and it is located at the loose-fill station 21. The speed of each of the conveyors 16 and 20 is preferably set at about 60 feet per minute.

A pair of successively acting centering electric eyes 22 and 23 are used to actuate the brake 17 to center the boxes 10 longitudinally relative to the conveyor 20 at the station 21, and thereby relative to a valve 32. A pair of double rod cylinders 24 and 25 is used for widthwise centering. The double rod cylinders 24 and 25 prevent rotation of a push bar 26 for each cylinder 24 or 25, without the need for linear bearings. Five magnetic reed switches 27 may be mounted on each centering cylinder 24 and 25 to provide positional feedback information to the computer 15 which sends the information on to a control system 28. Each centering cylinder 24, 25 moves forward, first one and then the other. Upon activating the appropriate reed switch 27 that corresponds to the size of the particular box 10 being processed is retracted backwards.

The valve 32 has an outlet pipe 34. The box 10 is thus centered longitudinally beneath the pipe 34 by the brake 17 stopping the conveyor 20, once an appropriate electric eye 22 or 23 is blocked. A control lag of about 0.5 second occurs between the time from an electric eye 22 or 23 (depending on box size) being blocked and the time when the conveyor 20 is stopped. Hence, the electric eyes 22 and 23 are preferably placed an inch ahead of the desired stopping place.

A pump-up cylinder 30 is an electrically actuated pneumatic cylinder that supports a platform 31 that it raises from below the conveyor 20 to lift the boxes 10 to a predetermined height relative to the valve 32. Positional feedback is by magnetic reed switches 33. The speed of the cylinder 30 can be adjusted by potentiometers 29 on the control system 28 and preferably can attain a maximum speed of about 10 inches per second with a load of about 135 pounds.

The key to obtaining the correct amount of loose fill in a box 10 is lifting the box 10 to a predetermined level. An overfilled box implies that the box 10 was not lifted high enough. An underfilled box corresponds to lifting the box too high. In order to fill 128 boxes per hour, filling should take about 28 seconds per box 10.

A loose-fill container or bag 35, shown only diagrammatically in FIGS. 1 and 2, contains loose fill 36 and has only a single opening 37, which typically may be about six inches in diameter, though it may be larger or smaller.

In tests, it was found that an ideal valve 32 should have the following features:

1. The valve 32 should be as large as possible, in order to ensure that the loose fill 36 can be evenly distributed in the box 10. However, the largest size of the valve 32 is limited by the size of the smallest box 10, as the valve 32 is placed inside each box 10 or rather surrounded by the box's flaps, which during filling are erect or vertical, during filling of that box 10.

2. A square valve 32 is better than a round one, because the loose fill 36 can thereby more easily flow into corners of the box 10.

3. The valve 32 should have gates 38, which are as unobstructive as possible so that they will not restrict either the size of the valve 32 or the maximum height at which components can be placed inside the box 10.

The gates 38 are a pair of members 40, 41, each pivoted at one end 42 or 43 and swing to operate the other ends 44 and 45 by a solenoid 46. are timed to close after a time by which the loose fill 36 has filled the box 10 or has clogged the pipe 34. A safety switch 39 is located adjacent to the valve 32 so that if any components come dangerously close to the valve 32 during pump-up, the pump-up cylinder 30 will be stopped immediately and an alarm sounded to alert the operator.

After the loose-filled box 10 has been lowered and placed again on the conveyor 20, it is sent to a leveling station 49, where two pairs 50 and 51 of simple air jets 52 and 53 level the loose fill "mountain" 54. The loose fill 36 is easily moved by a series of short blasts typically six or seven blasts air.

The box 10 is thus raised up to a predetermined distance beneath the fill pipe 34. The position of the platform 31 is determined by magnetically actuated reed switches 33. The speed at which the cylinder 30 can run is set by the computer 15. Also, the stopping position changes with the speed of the cylinder 30. The repeatability of the pump-up operation was approximately 1/10" for constant speed operation.

Once the box 10 is in position, the valve 32 opens for a fixed amount of time (depending on box size) and then closes. The whole purpose of raising the box 10 to a predetermined distance beneath the pipe 34 is to have the mound of fill 36 in the box 10 clog the pipe 34 once the box 10 is full, thus providing the correct amount of fill, regardless of the contents of the box 10. Once the pump-up height is adjusted, this technique works very well, filling every box 10 to the right amount regardless of size.

The computer 15 controls all of the operations of the filling machine. A complete cycle of the operation is as follows:

Start up: All the control parameters are set up on the computer 15 and the operation of the various components checked.

Matrix: The bar code 12 is read and the control parameters fixed.

Longitudinal centering: The box 10 is conveyed to reach the desired location on the conveyor 20 it intercepts the light-beam from the electric eye 22 or 23 to and back from a reflector 55 and 56 thus actuating the brake 17 to stop the conveyor 20.

Widthwise centering: The box 10 is centered to the center of the conveyor 20 by the cylinders 24 and 25.

Raise box: The box 10 is lifted to the correct height beneath the pipe 34.

Fill: The box 10 is loose-filled according to the box size. The valve 32 being opened and later closed by a solenoid 46.

Lower Box: The loose-filled box 10 is then lowered back down to the conveyor 20.

Blow: The mound 54 of loose fill 36 in the box 10 is leveled, using blasts of air.

An HP 3488A switching/control unit may serve as the interface between the computer 15 and the hardware. All the control algorithms may be written in HP-BASIC.

The two photoeyes 22 and 23 are used with the cylinders 24 and 25 to center the box 10 lengthwise and then widthwise relative to the valve 32. One photoeye 22 may be used for the shorter boxes, while the other photoeye 23 may be used with the larger boxes 10. The photoeyes 22 and 23 provide feedback to the control system 28 that, in turn, activates the conveyor brake 17 when the box 10 is in the correct position on the conveyor 20.

To control the valve 23, the centering cylinders 22 and 23, the conveyor brake 17 and the air-leveling, five single acting solenoid valves 27 may be used. Each valve 27 may have a built-in speed control to throttle the exhaust air. For controlling the flow and pressure of the air levelling jets, a throttle valve 57 may be used.

As noted earlier, the filling method leaves each box 10 with a "mountain" of loose fill 36 which must be leveled. Vibration tables are costly and complicated.

Instead, compressed air is used because the loose fill 36 is so easily moved by a light blast of air. It was found that many such devices were ineffective—including a hair dryer diffuser attachment, a table fan, a sprinkler head, a painting nozzle and an air bladder.

The various box sizes, mean that each loose fill "mountain" 54 may be at a different height. The device used in this invention needs no adjustment for the various box sizes.

A very small nozzle 52, 53 is very effective in moving the loose-fill particles 36. The blowing device of this apparatus uses two pairs of small air jets 52, 53 from the nozzles 50 and 51 held above the box 10 by a Plexiglas plate. By experimentation, the correct placement of the two pairs of jets 50 and 51 sets their distance above the box 10 to cover all heights, usable air pressures, and the time of each air blast.

The box 10 need not stop at the leveling station 49. Several air blasts may be used while the box 10 travels by. The blasts may be triggered after the box 10 has been lowered from the filling position to the conveyor 20.

Preliminary tests showed that the two pairs 50 and 51 of nozzles 52 and 53 approximately 5" apart, with members of each pair about one-half inch apart (along the center of the path of box travel on the conveyor 20) and 28" above the conveyor 20 level the mound of fill in all the box sizes. In practice, shooting seven blasts 0.25 second blasts of throttled air with 0.37 second in between blasts is sufficient to level the mound 54.

The two techniques which are critical to the machines performance are in the filling and blow leveling processes.

The filling process relies on the mound of loose fill 36 in the box 10 to reach the bottom of the pipe 34 and to clog the pipe 34 to insure the correct amount of fill in the box 10 regardless of the contents of the box 10. This technique is a reliable filling method. Once properly adjusted, it fills every box 10 correctly, regardless of the contents. The blow-leveling technique is used to level the mound 54 of fill before closing the box 10. Once adjusted, this technique is able to level the mound 54 in every size of box 10 from one simple location.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A computer-controlled loose fill feeding device for a series of boxes of various sizes, each box having thereon a bar code corresponding to said box's size and being open at the top thereof, comprising:

a computer having setting means for setting control parameters, reading means for reading the bar code on each box, said computer then adjusting said control parameters accordingly, a conveyor for moving the box horizontally, said conveyor having a brake, longitudinal centering means for centering the cylinders at a particular position determined by said bar code, and for simultaneously stopping the conveyor by actuating said brake, widthwise centering cylinders for centering the box relative to a predetermined position, a lift cylinder with a platform thereon for lifting the box to a fill height determined by said bar code and then stopping the lifting, filling means for filling the box by gravity with loose fill through a feed-in pipe until the feed-in pipe is clogged, and then automatically stopping the filling operation, lowering means for then lowering the lifting cylinder and the box down to the conveyor, and leveling means for blowing a series of blasts of air toward said loose-filled box, in order to level the loose fill in the box.

2. The device of claim 1 wherein said longitudinal centering means comprises a plurality of electric eyes and light beam means therefor along said second conveyor actuated by a box blocking a light beam to one said eye.

3. The device of claim 2 wherein said brake is controlled by said centering electric eyes for stopping said conveyor at a centering station.

4. The device of claim 1 wherein said lift cylinder has a piston supporting said platform and is at said centering station.

5. The device of claim 4 having along said piston a series of reed switches controlled by said reading means for controlling said predetermined height.

6. The device of claim 1 wherein said air-blast means comprises a pair of blowing means, each driving a pair of outlet nozzles.

7. A computer-controlled loose-fill feeding device for a series of open boxes of various sizes, each box having thereon a bar code corresponding to said box's size, comprising:

a computer having setting means for setting control parameters, reading means for reading the bar code on each box and for adjusting said control parameters accordingly, a conveyor for moving the box horizontally, said conveyor having a brake, longitudinal centering photoelectric means for centering the cylinders at a particular position when a beam to said photoelectric means is blocked by a said box and simultaneously stopping the conveyor by actuating said brake, widthwise centering cylinders for centering the box relative to a predetermined position, a lift cylinder with a platform thereon for lifting the box to a fill height determined by the computer and then stopping the lifting, filling means for filling the box with loose fill by gravity through a feed-in pipe until the feed-in pipe is clogged, and then automatically stopping the filling operation, lowering means for lowering the lifting cylinder and the box down to the conveyor, and leveling means for blowing a series of blasts of air toward said loose-filled box, in order to level the loose fill in the box.

8. A device for filling with loose fill open boxes containing products requiring loose-fill protection and position retention of said products, said boxes each bearing a bar code indication of their sizes, comprising a first lead-in conveyor portion and a second conveyor portion therebeyond fed by said lead-in conveyor portion, box feeding means for feeding one box at a time to said lead-in conveyor in random order, bar code reading means for scanning said bar code of each said box, one box at a time, while the box is on the lead-in conveyor, and deriving information therefrom, a control system having actuating means for receiving the information read from the bar code and using that information to initiate the control system and to actuate other machine elements, a pair of longitudinal centering electric eyes and light beam means therefor along said second conveyor, each said electric eye being actuated by a box blocking a light beam to that said eye, a conveyor brake controlled by said centering electric eyes for stopping the movement of said second conveyor at a centering station, widthwise centering cylinders at said centering station, a pump-up cylinder having a piston and a piston-supported platform at said centering station, raising means controlled by said control system for lifting a centered box by means of said pump-up cylinder and platform to a predetermined height determined by said control system from said information, a loose-fill valve having a supply of loose fill at its upper end that is fed to said valve via a feed pipe by gravity, valve-controlling means for opening and closing said loose-fill valve, said loose fill flowing by gravity once said valve is opened until its feed pipe is plugged and then being shut off, said control system then lowering said pump-up cylinder and said box back to said second conveyor, and air-blast means further along said second conveyor for leveling a mountain of loose fill that forms during the feeding of loose fill to said box.

9. A method for filling open boxes, containing such products as electronic equipment, with loose fill, comprising feeding the boxes one at a time, to a conveyor in random order, each box having a bar code thereon giving the box size, scanning each box bar code, centering each box longitudinally at a centering station along the conveyor, widthwise centering each box, lifting a centered box to a predetermined height conforming to said bar code, opening a fill valve for loose fill and feeding said loose fill to a said box through a feed pipe, by gravity, once the feed pipe is plugged, closing said valve, lowering the box to the conveyor, and sending a series of air-blasts to the box further along the conveyor to level any mountain of loose fill that may form during the feeding of the loose-fill.

10. A method for computer-controlled feeding of loose fill to an open box containing an article to be shipped, each said box having a bar code expressing the box's size, comprising:

a computer having setting means for setting control parameters, reading means for reading said bar code of each said box and adjusting said control parameters accordingly, a conveyor for moving the box horizontally, said conveyor having a brake, longitudinal centering means for centering the cylinders at a particular position determined by said bar code and said reading means when a beam to a photoelectric means is blocked and stopping the conveyor there by actuating said brake, widthwise centering cylinders for centering the box relative to a predetermined position, raising means for lifting the box to a correct height as determined by said bar code and said reading means and then stopping the lifting, filling means for filling the box by gravity with loose fill through a feed-in pipe until the feed-in pipe is clogged, and then automatically stopping the filling operation, lowering the loose-fill filled box down to the conveyor, and blowing a series of blasts of air toward said loose-filled box, in order to level the loose fill in the box.

11. A method for filling with loose fill each of a series of open boxes containing products requiring loose-fill protection and position retention of said boxes, each box bearing a bar coded indication of its sizes, comprising conveying said boxes along a path, feeding one box at a time to said path in random order, scanning said bar code of each said box, one box at a time, while the box is conveyed, and deriving the information therefrom, receiving the information read from the bar code and using that information to control the subsequent steps, longitudinally centering each said box that is conveyed, stopping the conveying movement of each said box at a centering station, widthwise centering each said box at said centering station, lifting a centered box to a predetermined height determined by the information on said box bar code, valve controlling means for opening and closing a fill valve for a supply of loose fill that is fed via a feed pipe to said valve by gravity, until its feed pipe is plugged, and then closing said valve, then lowering said box back to said second conveyor, and leveling a mountain of loose fill that forms during the feeding of loose fill to said box.

* * * * *